US005930917A

United States Patent [19]

Pavelescu et al.

[11] Patent Number: 5,930,917

[45] Date of Patent: Aug. 3, 1999

[54] WATERPROOF SHOE

[75] Inventors: Liviu-Mihai Pavelescu, Wuppertal; Manfred Günter Haderlein, Haan, both of Germany

[73] Assignee: Akzo Nobel NV, Arnhem, Netherlands

[21] Appl. No.: 08/952,515

[22] PCT Filed: May 31, 1996

[86] PCT No.: PCT/EP96/02362

§ 371 Date: Nov. 21, 1997

§ 102(e) Date: Nov. 21, 1997

[87] PCT Pub. No.: WO96/41549

PCT Pub. Date: Dec. 27, 1996

[30] Foreign Application Priority Data

| | | | |
|---|---|---|---|
| Jun. 9, 1995 | [DE] | Germany | 195 21 107 |
| Mar. 22, 1996 | [DE] | Germany | 196 11 337 |

[51] Int. Cl.[6] ..... A43B 13/28; A43B 13/08

[52] U.S. Cl. ..... 36/12; 36/14; 36/55; 12/142 T; 12/142 RS

[58] Field of Search ..... 36/12, 14, 16, 36/19.5, 55, 10; 12/142 RS, 142 T

[56] References Cited

U.S. PATENT DOCUMENTS

| | | | |
|---|---|---|---|
| 1,206,749 | 11/1916 | Burnham | 36/14 |
| 1,243,421 | 10/1917 | Kelly | 36/16 |
| 2,460,669 | 2/1949 | Ayers | 36/12 |
| 2,651,118 | 9/1953 | Root | 36/12 |
| 3,216,033 | 11/1965 | Nadler | 36/14 |
| 4,120,104 | 10/1978 | Lasmo | 36/14 |
| 5,628,127 | 5/1997 | Notzold | 36/14 |
| 5,732,479 | 3/1998 | Pavelescu | 36/12 |

FOREIGN PATENT DOCUMENTS

| | | |
|---|---|---|
| 0 679 347 A2 | 11/1995 | European Pat. Off. . |
| 0 713 657 A1 | 5/1996 | European Pat. Off. . |
| 857833 | 10/1940 | France . |
| 595 296 | 4/1934 | Germany . |
| 38 21 602 A1 | 3/1989 | Germany . |
| 40 07 962 A1 | 9/1990 | Germany . |
| 44 19 802 A1 | 12/1995 | Germany . |
| WO 90/06067 | 6/1990 | WIPO . |

OTHER PUBLICATIONS

Derwent Abstract 90–291461 (English language Abstract of DE 40 07 962 A1).

Derwent Abstract 96–021392 (English language Abstract of DE 44 19 802 A1).

*Primary Examiner*—M. D. Patterson
*Attorney, Agent, or Firm*—Oliff & Berridge, PLC

[57] ABSTRACT

A shoe structure includes an upper, including at least an outer layer and a lining, an insole, and a sole. The lining lines the inside of the outer layer and includes a waterproof and water-vapor permeable functional layer. The insole is connected to a lower end area of the outer layer. The lower end area of the lining is turned back to the inside in the sole area at least approximately parallel to the direction in which the sole extends, whereby the turned back area of the lining is shortened to a width of between 0.5 and 3 cm. Cut-outs are made in the insole, at least in the area in which the turned back lower end area of the lining ends. The lower end area of the lining is embedded in a synthetic material which fills the cut-outs in the insole in such a manner that at least the surface of the end area of the lining facing the inner area of the shoe structure forms a continuous surface with the surface of the synthetic material facing the inner area of the shoe structure. The functional layer is bonded with the synthetic material in a waterproof manner in the lower end area of the lining and at the extreme edge area of the lining.

15 Claims, 6 Drawing Sheets

WATERPROOF SHOE

BACKGROUND OF THE INVENTION

The invention relates to a shoe structure, which is at least part of a shoe and comprising: an upper, comprising at least one outer layer and a lining, which lines the inside of the outer layer and includes a waterproof and water-vapor permeable layer; an insole connected to the lower end area of the outer layer; and a sole.

Shoes which have a shoe structure with a lining that includes a waterproof and water-vapor permeable functional layer, are well known for their wearing comfort. It is, however, often difficult to guarantee waterproofing in this kind of shoe because, for example, every seam which is sewn into the lining can transport water to the inside of the shoe by capillary action. For this reason, the lining that includes a waterproof, water-vapor permeable functional layer is often constructed in the shape of a sock (better known as a booty), which is only connected to the outer layer at the upper opening of the shoe. In this case, the seams or other types of connection required for formation of the sock can be easily sealed with a waterproof adhesive tape, so that the sock design of the lining guarantees that the shoe is waterproof. However, using the sock design dictates that there must also be lining in the area of the sole, in order to seal the inner area hermetically against water, despite the fact that it is often unimportant whether or not the lining is water-vapor permeable in the sole area, because the sole material itself is not water-vapor permeable. For this reason, the expense involved in constructing the lining in the form of a sock (booty) is often too high for many purposes.

For this reason, a method has been used, for example in accordance with DE-A-38 21 602, in which a porous strip is inserted in shoes with an injection-molded sole, in order to connect the outer layer and the lining. During the injection moulding process, the material of the sole penetrates this porous strip right through to the lining, so that the seam which joins the porous strip to the lining is surrounded by the sole material. This embodiment cannot be used for certain types of shoe, for example shoes with a flex design. In shoes with flex construction, the lower area of the outer layer is turned back to the outside of the shoe so that this lower end area of the outer layer is at least approximately parallel to the outsole and sewn to the insole. In this case, the extreme edge of the turned-back end area of the outer layer and the extreme edge of the sole have the same contour. In order to guarantee that the shoe is waterproof, these types of shoe are still made using the more expensive "sock" construction method.

SUMMARY OF THE INVENTION

The object of the present invention is to construct a shoe structure of the kind mentioned earlier in such a manner that its production is less expensive, or at least to use as little as possible of the expensive lining which includes a waterproof and water-vapor permeable layer in the areas where water-vapor permeability is not required. Most particularly, the shoe structure should be suitable for manufacturing shoes with a flex construction.

The solution to these problems is a shoe structure in accordance with the introducing part of claim 1, as follows: the lower end area of the lining is turned back to the inside in the sole area at least approximately parallel to the direction in which the sole extends, whereby the area of the lining which is turned back is shortened to a width of between 0.5 and 3 cm; at least cut-outs are made in the insole, at least in the area in which the turned back, lower, end area of the lining ends; the lower end area of the lining is embedded in a synthetic material, which fills the cut-outs in the insole, in such a manner that at least the surface of the end area of the lining facing the inner area of the shoe structure forms a continuous surface with the surface of the synthetic material facing the inner area of the shoe structure, and the functional layer is bonded with the synthetic material in a waterproof manner in the lower end area of the lining and at the extreme edge of the lining.

DETAILED DESCRIPTION OF PREFERRED EMBODIMENTS

Figure 1:
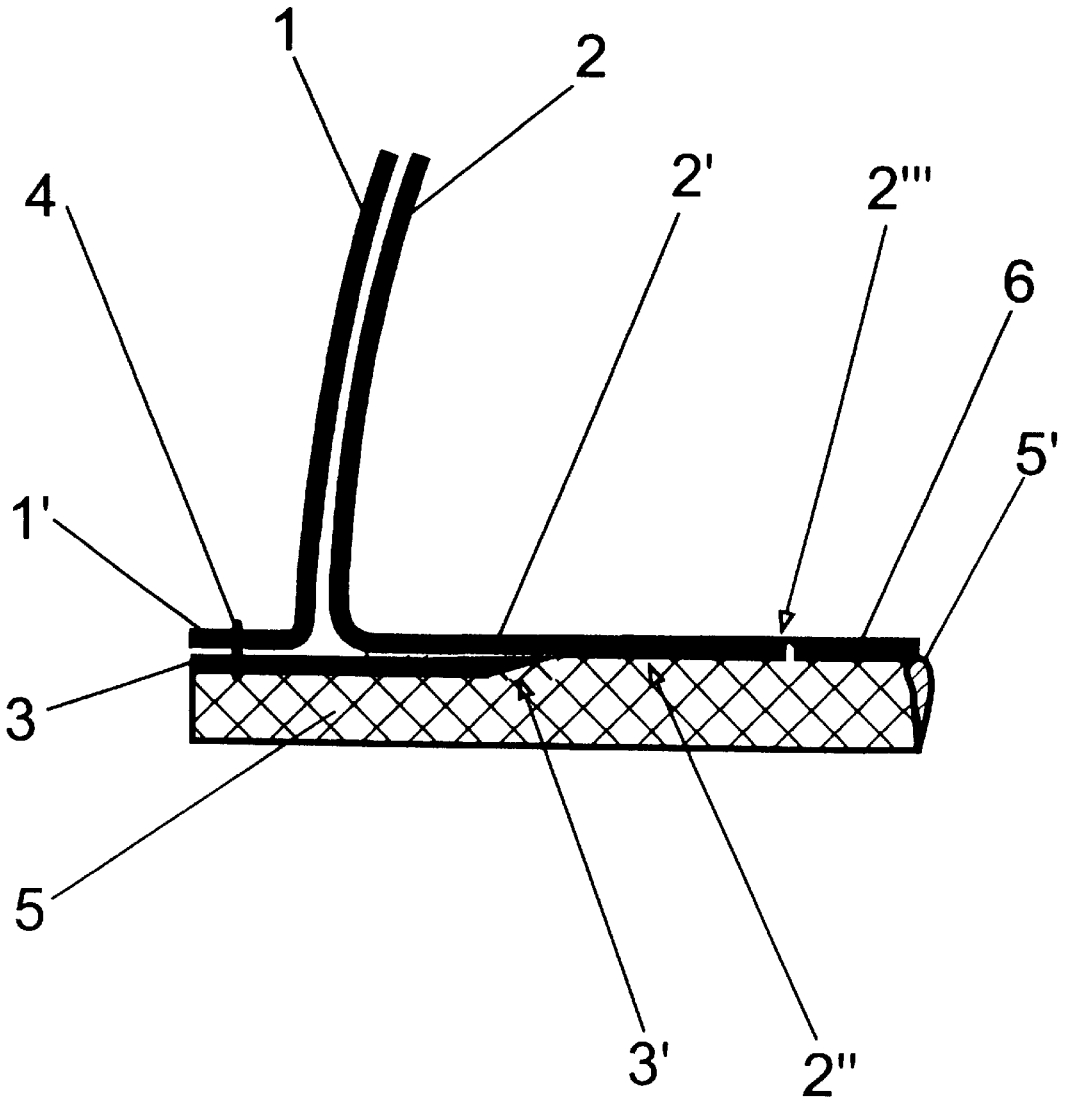
FIG. 1 is a partial section through the shoe of the invention.

It is preferable for the width of the area of the lining which is turned back to measure between 1.5 and 2.5 cm, whereby a width of between 1.5 and 2.0 cm has proved most effective.

A shoe structure of this kind can be manufactured by a simple method, in which the lining is pulled over the last and the insole then bonded to the lining, for example by gluing them together. In the most simple cases, and where injection-molded soles are used, the insole is only joined to the outer layer by the material of the sole. It is, however, also possible to sew the insole to the lower part of the outer layer.

In a preferred embodiment, the area of the lining which is turned back is glued to the insole. The area of the lining which is turned back must be wide enough to form a waterproof connection between the lining and the insole which is sufficiently strong for use of the shoe. A width of between 1 and 2 cm is generally adequate for this purpose.

Particularly good results are achieved in the shoe structure of the invention when the sole is injection molded or glued to the synthetic material and the insole. This is where the versatility of the shoe structure of the invention becomes apparent.

It has been found particularly effective for the sole to be injection molded onto the shoe and at the same time act as the synthetic material in which the lower end area of the lining is embedded.

During the process of injection moulding, the cut-outs in the insole allow the synthetic material or the sole material to penetrate through to the lining and form a waterproof connection with it. It is not necessary here, as described in DE-A-38 21 602, to use a porous bonding material, which would make production of this shoe unnecessarily expensive. For the injection moulding process, only the lower area of the lining needs to be pulled over the last, the insole with cut-outs glued into place, the insole sewn to the section of the outer layer which is turned back, and the synthetic material, which should ideally also be the sole material, then injection molded onto the structure. The synthetic material penetrates through the cut-outs to the lining, but can only penetrate as far as the last, for which reason the last should ideally be treated with a non-stick coating. The lining used here should ideally be constructed so that the waterproof, water-vapor permeable layer is layered with a standard lining towards the inner area of the shoe, while the waterproof, water-vapor permeable layer is reinforced on the outer side by a flat textile structure; on the one hand, this strengthens the lining adequately and on the other, it can be easily penetrated by the synthetic material, so that an effective waterproof bond is formed with the waterproof, water-vapor permeable layer. During this process, the flat textile structure, which can be a woven, knitted or nonwoven fabric, is penetrated and surrounded by the synthetic material, with the effect that exactly this layer which gives the lining its necessary strength is sufficiently bonded to the insole and/or the sole material by the synthetic material. This connection is characterised by being sufficiently strong for use of the shoe. It is no longer possible for water to penetrate to the inside of the shoe through this connection. In order to improve fabrication of the shoe, the free space formed by the shortened lining can be bridged with a porous material, such as netting or textile lattice or a lining sole, which can, for example, be joined to the lining by sewing it in place.

The shoe structure of the invention is characterised in particular by the insole having only a single cut-out, the cut edge of which runs at least approximately parallel to the extreme edge of the end area of the lining which is turned back. In production of the shoe structure, the synthetic mass used in the injection moulding process is able to penetrate particularly easily through to the lining to form a waterproof bond. During this injection moulding process, the sole material penetrates as far as the insole in the outer area and as far as the lining in the cut area, and in the area where there is neither insole nor lining, it penetrates as far as the last, which has a non-stick coating. In this respect, the shoe structure of the invention has proven particularly successful when the synthetic material is bonded in a watertight manner with the free parts of the area which is turned back, in particular the extreme edge of the area of the lining which is turned back. In this way, the edge is also bonded with the synthetic material in a watertight manner, so that additional protection is provided against penetrating water.

It is advantageous here if the injection moulding process is executed so that the surface of the sole material facing the inner area of the shoe forms a continuous surface with the turned back area of the lining facing the inner area of the shoe. This can be guaranteed by using a suitably shaped last. With a shoe of this kind, it is even possible to do without a lining sole. The wearer of the shoe is still provided with the comfort he expects, because the inner side of the sole forms a continuous surface and does not, therefore, have any uncomfortable creases and/or steps in it. It can also be advantageous here for the part of the lining which is turned back to be cut into in the area of the heel and/or in the area of the toe and bonded in a watertight manner after it is turned back, so that the formation of creases is also prevented in these critical zones.

The shoe structure of the invention is characterised in particular by the lower end area of the lining being bonded to a lining sole, whereby the extreme edge of the lower area of the lining which is turned back and the outer edge of the lining sole have a space between them. This space is filled by the synthetic material in such a manner that the surfaces facing the inside of the shoe structure of the lower end area of the lining which is turned back, of the synthetic material and of the lining sole form a continuous surface. In this way, a support for the lining is formed by the lining sole, so that the end area of the lining which is turned back is kept smooth in a particularly practical manner during injection moulding of the synthetic material, and creases are effectively prevented from forming. It has been found particularly effective here if the lower end area of the lining is sewn to the lining sole and the sewing threads which connect the lining and the lining sole are at least partially embedded in the synthetic material. It is particularly advantageous if these sewing threads are monofilaments, so that capillary forces cannot occur in the sewing thread. If multifilament threads are used, impregnation is recommended so that spaces between the filaments in the thread are filled with the impregnating agent.

The shoe structure of the invention is ideal for use in shoe structures where the lower end area of the outer layer is essentially perpendicular to the underside of the outsole. In the simplest case, the synthetic material is sufficient in itself to form a good connection between the lower area of the outer layer and the insole, especially when the synthetic material is also the sole material and the outsole is injection molded. The reason for this is that in the process used for injection moulding soles, the synthetic material of the sole surrounds the insole and the outer layer from the outside and bonds to the insole and the outer layer. The shoe structure of the invention has proven particularly successful for use in so-called Strobel shoe structures (made using a Strobel sewing machine), in which the lower end area of the outer layer is sewn to the insole.

In order to guarantee that the shoe retains its shape, it can also be advantageous for the insole to have a porous support structure, at least in the ankle area, which can be penetrated by the synthetic material and is connected to the insole. In particular in cases where the insole has only one cut-out, the support structure of the insole bridges the cut-out, guaranteeing that the shape of the insole and consequently the shape of the outer layer connected to the insole is maintained. It is also advantageous here for the support structure to be made of netting, ideally manufactured from monofilament.

Particular benefits can be gained by using the shoe structure of the invention when it is designed with a flex construction, whereby the outer layer in the area of the sole is turned back to the outside of the shoe in such a manner that the part of the outer layer which is turned back is positioned and sewn to the insole at least approximately parallel to the direction in which the sole extends. This method also guarantees good waterproofing. In one case, the lining in the lower end area which is turned back is densely embedded in the synthetic material, whereby a sufficient quantity of plastic is injected to fill the cut-out formed by the insole right through to the outsole side. In this embodiment a sole can now either be glued on or formed by injection moulding. The process in which the lower end area of the lining is embedded can, however, also be carried out directly with the injection moulding of the sole material.

The outer layer is turned back to the outside of the shoe in the sole area in such a manner that the turned-back part 1' of the outer layer 1 is positioned at least approximately parallel to the direction in which the sole 5 extends. Positioned between the sole 5 and the turned back part 1' of the outer layer is an insole 3, which is sewn to the turned back part 1' of the insole 3 with a seam 4. In the context of the present invention, this shoe structure is known as a flex construction shoe structure. In FIG. 1, the insole 3 is cut into towards the center and has an edge 3' which is overhung by the turned back part 2' of the lining 2 by the area 2". In this area, in which the insole 3 and the turned back part of the lining overlap, the insole and lining are glued together. A waterproof adhesive is recommended for gluing them together. A lining sole 6 is connected to the turned back end area 2' of the lining 2.

Figure 2:
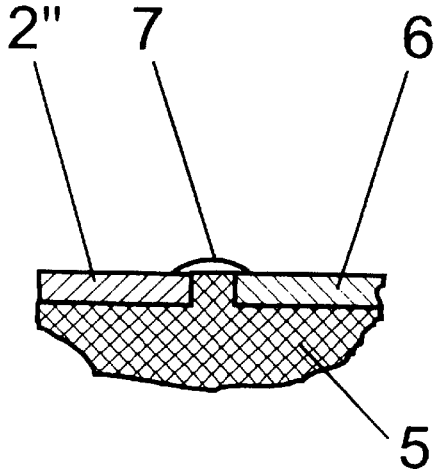
FIG. 2 is a detail of the partial section shown in FIG. 1.

In the embodiment illustrated, the sole 5 forms a continuous surface with the turned back part 2' of the lining 2 and the lining sole 6, as shown in a magnified view in FIG. 2. In this case, the lining is connected to the lining sole with a seam 7, which is partially embedded in the material of the sole. In the context of the present invention, a continuous surface means that the material of the sole on the inside of the shoe forms a surface with the turned back part 2" of the lining 2 and that there is no raised or recessed area which can be felt at the transition point 2'" between the lining and the material of the sole. The sole is depicted broken off towards the center (5').

Figure 3:
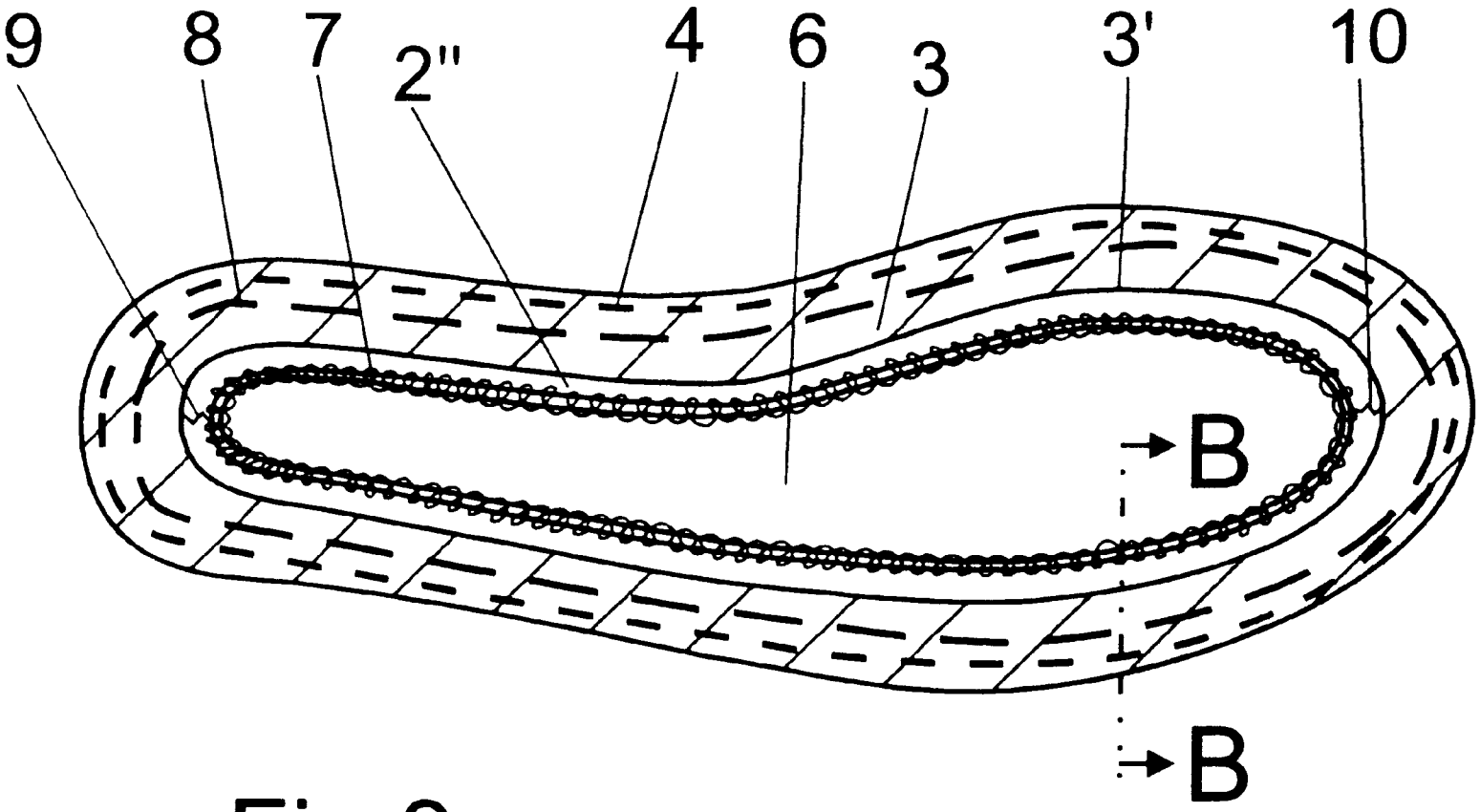
FIG. 3 is a view from below of the further embodiment of the shoe of the invention, in which the insole in the inner area has one cut-out, whereby the shoe is depicted without the sole.

In FIG. 3, the shoe depicted in FIG. 1 is shown from below, whereby the sole material has been omitted and the line 8 has been used to illustrate the contour around which the outer layer 1 is turned back to the outside and the lining 2 is turned back to the inside. In the toe area 10 and in the heel area 9, the turned back part of the lining 2 has been cut into, shortened, sewn together and bonded in a waterproof manner with adhesive tape, which is an effective means of preventing the formation of uncomfortable creases. The lining is usually shortened at the toe and heel in the following manner: a triangular section is cut out in these areas and the cut edges of the lining then placed together and the edges sewn up (a dart is made). In this way, it is possible to prevent creasing in the turned back area of the lining 2.

Figure 4:
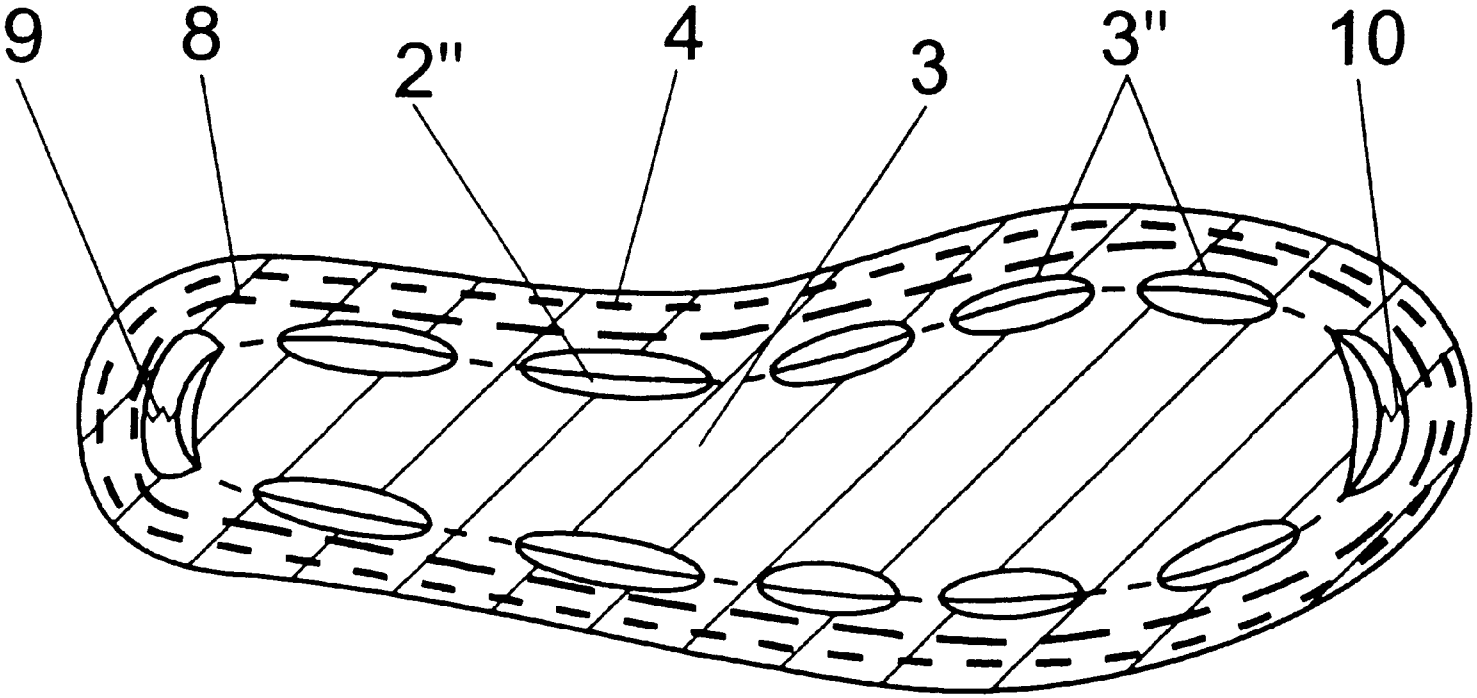
FIG. 4 is a view from below of the shoe of the invention shown without the sole, where the insole has several cut-outs.

FIG. 4 illustrates a further embodiment of the invention, in which the insole 3 has several cut-outs 3", whereby the cut-outs 3" are arranged so that the inner edge 2'" of the end area 2" of the lining 2 is visible in their vicinity. In this way, the material of the sole is able to flow through the cut-outs in the insole during the injection moulding process and bond with the lining on the underside and edges.

It goes without saying that before the sole is injection molded, a last must be inserted in the shoe which is coated with a release agent; this release agent effectively prevents adhesion of the sole material to the last.

Figure 5:
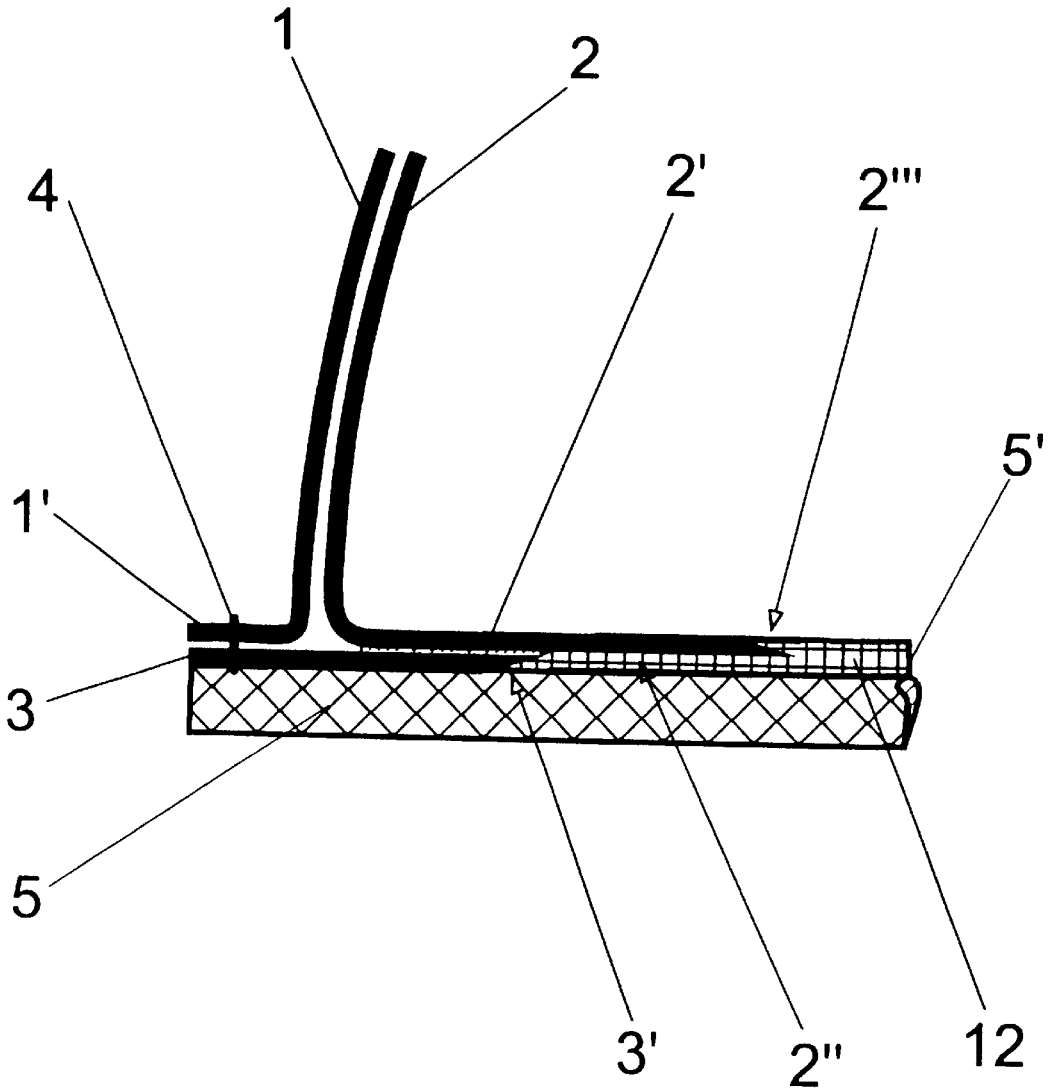
FIG. 5 is a partial section through a further embodiment of the shoe of the invention.

In FIG. 5, the partial section illustrated in FIG. 1 is shown again, whereby the sole material 5 now only extends as far as the insole 3, and the area facing the inside of the shoe between the insole 3 and lining 2 is filled with a synthetic material 12. This synthetic material may be an adhesive or other hardening plastic which should be at least approximately as flexible as the sole material, but may also be more flexible than the sole material. This synthetic material can be injection molded into the cavity formed by the insole and the lining using a last, which also makes it possible to use a sole which is glued into place without an undesirable cavity forming between the sole and the inner area of the shoe.

Figure 6:
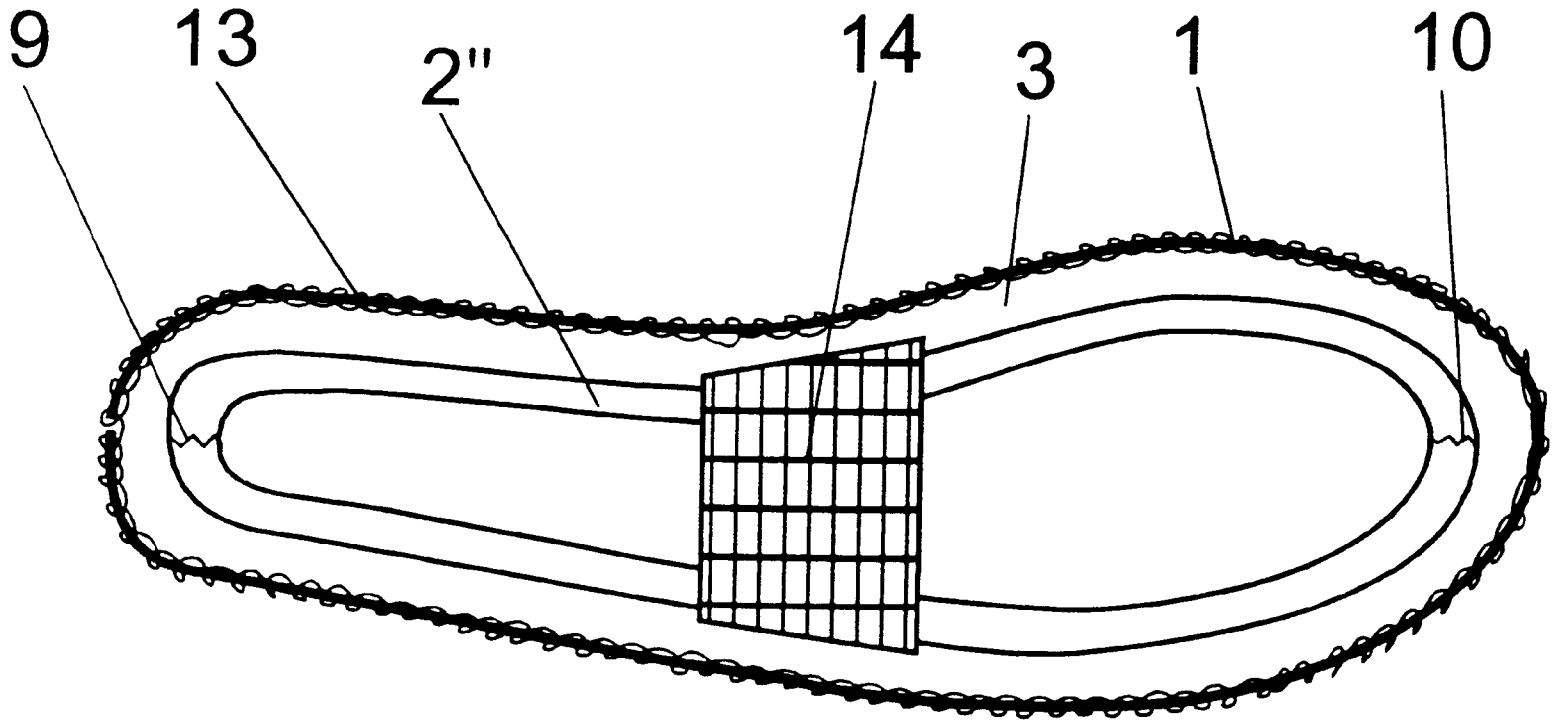
FIG. 6 is a further embodiment of the shoe structure of the invention viewed from below.
Figure 7:
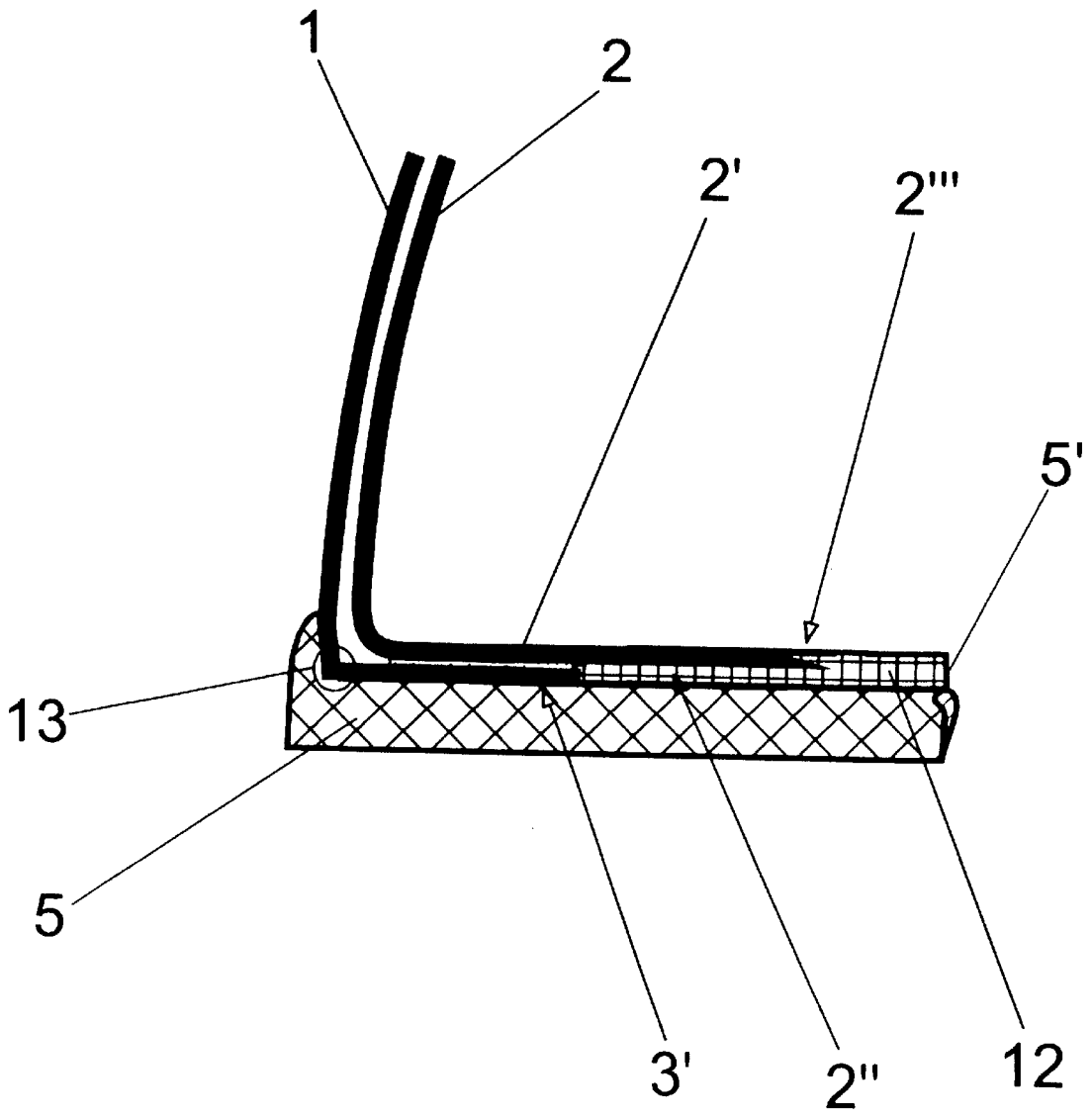
FIG. 7 is a partial section through the shoe structure shown in FIG. 6.

FIG. 6 shows a further shoe based on the shoe structure of the invention, viewed from below. Here, the insole 3, into which a cut has been made, is sewn to the lower edge of the outer layer with seam 13 (Strobel-machine method). In order to improve the shape retention of the outer layer, a netting 14 made from monofilament is sewn to the insole 3 (seam not illustrated), whereby the netting 14 bridges the cut-out in the insole 3. FIG. 7 shows a partial section of the embodiment illustrated in FIG. 6. Here too, the lining is embedded in a synthetic material 12 before the sole 5 is injection molded onto the shoe. As can be clearly seen in this partial section, the second partial section 2" of the lower turned back end area of the lining 2 and the extreme edge 2'" of the lining are surrounded by the synthetic material; this makes it practically impossible for moisture to penetrate from the outside, either between the material of the sole and the insole or between the lower area of the lining and the insole (water which has penetrated through the outer layer).

What is claimed is:

1. A shoe structure, which is at least part of a shoe, comprising:

an upper, comprising at least an outer layer and a lining, which lines an inside of the outer layer and includes a waterproof and water-vapor permeable functional layer;

an insole connected to a lower end area of the outer layer; and a sole, wherein a lower end area of the lining is turned back to an inside of the shoe structure in a sole area at least approximately parallel to a direction in which the sole extends, whereby the turned back lower end area of the lining is shortened to a width of between 0.5 and 3 cm, wherein only a single cut-out is made in the insole, at least in an area in which the turned back lower end area of the lining ends, wherein the turned back lower end area of the lining is embedded in a synthetic material which fills the at least one cut-out in the insole in such a manner that at least a surface of the turned back lower end area of the lining facing an inner area of the shoe structure forms a continuous surface with a surface of the synthetic material facing the inner area of the shoe structure, wherein the waterproof and water-vapor permeable functional layer is bonded with the synthetic material in a waterproof manner in the turned back lower end area of the lining and at an extreme edge of the turned back lower end area of the lining, and wherein a cut edge of the single cut-out runs at least approximately parallel to the extreme edge of the turned back lower end area of the lining.

2. A shoe structure in accordance with claim 1, wherein the turned back lower end area of the lining is glued to the insole.

3. A shoe structure in accordance with claim 1, wherein the sole is injection molded or glued onto the synthetic material and the insole.

4. A shoe structure in accordance with claim 1, wherein the sole is injection molded onto the shoe and acts as the synthetic material in which the turned back lower end area of the lining is embedded.

5. A shoe structure in accordance with claim 1, wherein the insole is cut out so that the turned back lower end area of the lining projects beyond the insole in the cut out area.

6. A shoe structure in accordance with claim 1, wherein the synthetic material surrounds the turned back lower end area of the lining from a sole side and the extreme edge of the turned back lower end area.

7. A shoe structure in accordance with claim 1, wherein the turned back lower end area of the lining is connected to a lining sole, wherein the extreme edge of the turned back lower end area of the lining and an outer edge of the lining sole have a space between them that is filled by the synthetic material in such a manner that surfaces facing the inside of the shoe structure of the turned back lower end area of the lining, of the synthetic material and of the lining sole form a continuous surface.

8. A shoe structure in accordance with claim 7, wherein the turned back lower end area of the lining is sewn to the lining sole, and sewing threads which connect the lining and the lining sole are at least partially embedded in the synthetic material.

9. A shoe structure in accordance with claim 8, wherein the sewing threads are monofilaments.

10. A shoe structure in accordance with claim 1, wherein a lower portion of the outer layer is essentially perpendicular to the sole.

11. A shoe structure in accordance with claim 10, wherein the lower end area of the outer layer is sewn to the insole.

12. A shoe structure in accordance with claim 10, wherein the insole has a porous support structure which can be penetrated by the synthetic material and is connected to the insole.

13. A shoe structure in accordance with claim 12, wherein the porous support structure is a netting manufactured from monofilament.

14. A shoe structure in accordance with claim 12, wherein the porous support structure of the insole is at least in the ankle area.

15. A shoe structure in accordance with claim 1, wherein the shoe structure is constructed in a flex design, wherein the outer layer is turned back to an outside of the shoe in the sole area in such a manner that the turned-back part of the outer layer is positioned at least approximately parallel to the direction in which the sole extends and is sewn to the insole.

* * * * *

UNITED STATES PATENT AND TRADEMARK OFFICE

CERTIFICATE OF CORRECTION

PATENT NO. : 5,930,917

DATED : August 3, 1999

INVENTOR(S) : Liviu-Mihai PAVELESCU and Manfred Gunter HADERLEIN

It is certified that error appears in the above-identified patent and that said Letters Patent is hereby corrected as shown below:

Column 4, after line 62, please add the following paragraph:

--Figure 1 shows a partial section through a shoe of the invention, for example as illustrated in Fig. 3 by the cross-section marked BB. The shaft comprises an outer layer 1 which may be made of leather or a textile material. Inside the outer layer is a lining 2, which contains a waterproof, water-vapour permeable functional layer, which is not illustrated in the diagram, and generally has a flat textile structure such as a knitted, woven or nonwoven fabric against its inner side. The side of the lining facing the outer layer 1 generally has a further flat textile structure adjacent to it which serves as reinforcement for the functional layer. A laminate formed from three layers of this kind (the three layers are joined together) has become well known under the brand name of SYMPATEX.--

Column 5, line 11, "2'" should be --2"--.

Signed and Sealed this

Fourteenth Day of March, 2000

*Attest:*

Q. TODD DICKINSON

*Attesting Officer*

*Commissioner of Patents and Trademarks*